US009129494B2

(12) United States Patent
Valiulis et al.

(10) Patent No.: US 9,129,494 B2
(45) Date of Patent: Sep. 8, 2015

(54) ALARMING PUSHER SYSTEM

(71) Applicants: Thomas E. Valiulis, Rockford, IL (US); Jörg Niederhüfner, Rockford, IL (US)

(72) Inventors: Thomas E. Valiulis, Rockford, IL (US); Jörg Niederhüfner, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 164 days.

(21) Appl. No.: 13/713,886

(22) Filed: Dec. 13, 2012

(65) Prior Publication Data

US 2014/0167962 A1 Jun. 19, 2014

(51) Int. Cl.
*G08B 13/14* (2006.01)
*A47F 1/12* (2006.01)

(52) U.S. Cl.
CPC ..... *G08B 13/14* (2013.01); *A47F 1/126* (2013.01)

(58) Field of Classification Search
USPC ..... 340/309.4, 500, 502, 527, 528, 539.16, 340/566, 568.8, 686.1, 691.5; 211/59.3; 200/4, 461, 524, 530; 700/224, 231
See application file for complete search history.

(56) References Cited

U.S. PATENT DOCUMENTS

| | | | | | |
|---|---|---|---|---|---|
| 2,358,658 | A | * | 9/1944 | Riche et al. | 200/461 |
| 2,398,411 | A | * | 4/1946 | Cook | 367/129 |
| 2,996,593 | A | * | 8/1961 | McMains | 200/524 |
| 3,550,121 | A | * | 12/1970 | Porter, Jr. | 340/502 |
| 3,706,309 | A | * | 12/1972 | Toftness | 606/238 |
| 3,848,745 | A | | 11/1974 | Smith | |
| 3,852,735 | A | * | 12/1974 | Matsuda et al. | 348/153 |
| 3,983,341 | A | * | 9/1976 | Stanish | 200/16 D |
| 4,001,805 | A | * | 1/1977 | Golbe | 340/527 |
| 4,020,305 | A | * | 4/1977 | Schwartz | 200/530 |
| 4,021,796 | A | * | 5/1977 | Fawcett et al. | 340/500 |
| 4,122,437 | A | * | 10/1978 | Petersen | 340/528 |
| 4,166,273 | A | * | 8/1979 | Riley et al. | 340/539.16 |
| 4,227,188 | A | * | 10/1980 | Petersen | 340/566 |
| 4,269,025 | A | * | 5/1981 | Kondo | 368/73 |

(Continued)

FOREIGN PATENT DOCUMENTS

| | | | |
|---|---|---|---|
| DE | 20 2005 010 088 | U1 | 9/2005 |
| EP | 0 868 871 | A1 | 10/1998 |

(Continued)

OTHER PUBLICATIONS

POS Tuning—für mehr Erfolg am Point of Sale: POS T-Product Pusher; http://www.postuning.de/69.0.html?&L=2; website; Mar. 29, 2006; 1 page.

(Continued)

*Primary Examiner* — Paul Obiniyi
(74) *Attorney, Agent, or Firm* — Reinhart Boerner Van Deuren P.C.

(57) ABSTRACT

An alarm device configured to monitor retail merchandise on a retail pusher system is provided. The alarm device includes a triggering mechanism that activates an alarm when retail merchandise is removed from the retail pusher system. The alarm makes store personnel aware that retail merchandise has been removed from a particular pusher system. In certain embodiments of the invention, the alarm device is disposed on a front stop of the retail pusher system. A biasing member of the pusher system biases retail merchandise into a switch of the alarm device. In this configuration, the alarm device may include a plunger switch that activates an alarm when retail merchandise is not biased into the plunger switch.

13 Claims, 5 Drawing Sheets

(56) References Cited

U.S. PATENT DOCUMENTS

| | | | | |
|---|---|---|---|---|
| 4,289,242 | A | 9/1981 | Kenyon | |
| 4,311,889 | A * | 1/1982 | Blanchard et al. | 200/52 R |
| 4,352,170 | A * | 9/1982 | Jetter | 368/73 |
| 4,352,171 | A * | 9/1982 | Jetter | 368/73 |
| 4,370,069 | A * | 1/1983 | Nomura | 368/273 |
| 4,384,906 | A * | 5/1983 | Molinari et al. | 156/86 |
| 4,470,236 | A * | 9/1984 | MacDonald, Jr. | 52/394 |
| 4,475,658 | A | 10/1984 | Roberts | |
| 4,675,654 | A * | 6/1987 | Copeland | 340/502 |
| 4,712,694 | A | 12/1987 | Breslow | |
| 4,742,923 | A | 5/1988 | Calvert | |
| 4,821,894 | A | 4/1989 | Dechirot | |
| 4,830,201 | A | 5/1989 | Breslow | |
| 4,836,390 | A | 6/1989 | Polvere | |
| 4,870,228 | A * | 9/1989 | Speer et al. | 200/4 |
| 4,887,737 | A | 12/1989 | Adenau | |
| 4,899,668 | A | 2/1990 | Valiulis | |
| 4,901,869 | A | 2/1990 | Hawkinson et al. | |
| 4,942,386 | A * | 7/1990 | Willis | 340/566 |
| 4,962,367 | A * | 10/1990 | Tymn | 340/309.4 |
| 4,967,044 | A * | 10/1990 | Speer et al. | 200/4 |
| 5,009,334 | A | 4/1991 | Bodkins | |
| 5,083,638 | A | 1/1992 | Schneider | |
| 5,114,021 | A | 5/1992 | Fredrickson | |
| 5,161,704 | A | 11/1992 | Valiulis | |
| 5,222,608 | A | 6/1993 | Eklof et al. | |
| 5,240,126 | A | 8/1993 | Foster et al. | |
| 5,255,182 | A * | 10/1993 | Adams | 705/17 |
| 5,265,738 | A | 11/1993 | Yablans et al. | |
| 5,335,892 | A * | 8/1994 | Busch | 248/551 |
| 5,397,856 | A * | 3/1995 | Lee | 174/520 |
| 5,641,077 | A | 6/1997 | Tufano et al. | |
| 5,671,851 | A | 9/1997 | Johnson et al. | |
| 5,685,664 | A | 11/1997 | Parham et al. | |
| 5,690,238 | A | 11/1997 | Schmehr | |
| 5,730,320 | A | 3/1998 | David | |
| 5,748,082 | A * | 5/1998 | Payne | 340/568.1 |
| 5,839,588 | A | 11/1998 | Hawkinson | |
| 5,855,282 | A | 1/1999 | Hardy | |
| 5,906,283 | A | 5/1999 | Kump et al. | |
| 5,971,173 | A | 10/1999 | Valiulis et al. | |
| 6,041,720 | A | 3/2000 | Hardy | |
| 6,082,558 | A | 7/2000 | Battaglia | |
| 6,102,192 | A | 8/2000 | Tomuro et al. | |
| 6,105,791 | A | 8/2000 | Chalson et al. | |
| 6,109,458 | A | 8/2000 | Walsh et al. | |
| 6,129,218 | A | 10/2000 | Henry et al. | |
| 6,131,748 | A | 10/2000 | Kawasaki et al. | |
| 6,158,598 | A | 12/2000 | Josefsson | |
| 6,269,285 | B1 | 7/2001 | Mignault | |
| 6,286,690 | B1 | 9/2001 | Thalenfeld | |
| 6,409,028 | B2 | 6/2002 | Nickerson | |
| 6,474,478 | B1 | 11/2002 | Huehner et al. | |
| D472,331 | S | 3/2003 | Zadak | |
| D480,231 | S | 10/2003 | Valiulis et al. | |
| 6,659,291 | B2 | 12/2003 | Huehner et al. | |
| 6,769,552 | B1 | 8/2004 | Thalenfeld | |
| 6,820,754 | B2 | 11/2004 | Ondrasik | |
| 6,824,009 | B2 | 11/2004 | Hardy | |
| 6,874,684 | B1 | 4/2005 | Denenberg et al. | |
| 6,886,699 | B2 | 5/2005 | Johnson et al. | |
| 6,889,854 | B2 | 5/2005 | Burke | |
| 6,923,330 | B1 | 8/2005 | Nagel | |
| 6,964,235 | B2 | 11/2005 | Hardy | |
| 7,007,810 | B2 | 3/2006 | Huehner et al. | |
| 7,293,663 | B2 | 11/2007 | Lavery, Jr. | |
| 7,347,335 | B2 * | 3/2008 | Rankin et al. | 211/59.3 |
| 7,395,938 | B2 | 7/2008 | Merit et al. | |
| 7,533,784 | B2 | 5/2009 | Vlastakis et al. | |
| 7,566,037 | B2 | 7/2009 | Vogler | |
| 7,768,399 | B2 | 8/2010 | Hachmann et al. | |
| 7,792,711 | B2 * | 9/2010 | Swafford et al. | 705/28 |
| 7,905,364 | B2 | 3/2011 | Pail | |
| 8,016,128 | B2 * | 9/2011 | Valiulis et al. | 211/59.3 |
| 8,069,994 | B2 * | 12/2011 | Barkdoll | 211/59.3 |
| 8,240,486 | B2 | 8/2012 | Niederhuefner et al. | |
| 8,260,456 | B2 * | 9/2012 | Siegel et al. | 700/244 |
| 8,276,766 | B2 * | 10/2012 | Rataiczak et al. | 211/59.3 |
| 8,328,027 | B2 * | 12/2012 | Barkdoll | 211/59.3 |
| 8,360,253 | B2 * | 1/2013 | Hardy | 211/59.3 |
| 8,443,988 | B2 * | 5/2013 | Niederhuefner | 211/59.3 |
| 2001/0002210 | A1 | 5/2001 | Petite | |
| 2001/0044751 | A1 | 11/2001 | Pugliese, III et al. | |
| 2002/0004690 | A1 | 1/2002 | Paulucci et al. | |
| 2002/0108916 | A1 | 8/2002 | Nickerson | |
| 2003/0004784 | A1 | 1/2003 | Li et al. | |
| 2003/0029816 | A1 | 2/2003 | Huehner et al. | |
| 2003/0057167 | A1 | 3/2003 | Johnson et al. | |
| 2004/0034581 | A1 | 2/2004 | Hill et al. | |
| 2004/0053044 | A1 * | 3/2004 | Moreno et al. | 428/343 |
| 2004/0073334 | A1 | 4/2004 | Terranova | |
| 2004/0084386 | A1 | 5/2004 | Huehner et al. | |
| 2004/0124201 | A1 | 7/2004 | Hieb | |
| 2005/0040123 | A1 | 2/2005 | Ali | |
| 2005/0056602 | A1 | 3/2005 | Hardy | |
| 2005/0098626 | A1 | 5/2005 | Jordan et al. | |
| 2005/0168345 | A1 * | 8/2005 | Swafford et al. | 340/686.1 |
| 2005/0189309 | A1 | 9/2005 | Hardy | |
| 2005/0189369 | A1 | 9/2005 | Vlastakis et al. | |
| 2005/0279722 | A1 | 12/2005 | Ali | |
| 2005/0288708 | A1 * | 12/2005 | Kammerer et al. | 606/221 |
| 2006/0049122 | A1 | 3/2006 | Mueller et al. | |
| 2006/0068144 | A1 * | 3/2006 | Mizuno et al. | 428/40.1 |
| 2006/0163180 | A1 * | 7/2006 | Rankin et al. | 211/59.3 |
| 2006/0219517 | A1 | 10/2006 | Cheng et al. | |
| 2006/0226095 | A1 | 10/2006 | Hardy | |
| 2007/0050271 | A1 | 3/2007 | Ufford et al. | |
| 2007/0095903 | A1 | 5/2007 | Suenbuel | |
| 2007/0108142 | A1 * | 5/2007 | Medcalf et al. | 211/59.3 |
| 2007/0251900 | A1 | 11/2007 | Hardy | |
| 2007/0267364 | A1 | 11/2007 | Barkdoll | |
| 2007/0267367 | A1 | 11/2007 | Mueller et al. | |
| 2007/0273513 | A1 | 11/2007 | White | |
| 2008/0015956 | A1 | 1/2008 | Regard | |
| 2008/0203253 | A1 | 8/2008 | Vogler | |
| 2008/0309489 | A1 | 12/2008 | Hachmann et al. | |
| 2009/0006196 | A1 | 1/2009 | Barkan et al. | |
| 2009/0101606 | A1 | 4/2009 | Olson | |
| 2009/0174566 | A1 * | 7/2009 | Volk et al. | 340/691.5 |
| 2009/0248198 | A1 * | 10/2009 | Siegel et al. | 700/231 |
| 2010/0012602 | A1 * | 1/2010 | Valiulis et al. | 211/59.3 |
| 2010/0200526 | A1 * | 8/2010 | Barkdoll | 211/59.3 |
| 2010/0268792 | A1 | 10/2010 | Butler et al. | |
| 2011/0168652 | A1 * | 7/2011 | Barkdoll | 211/59.3 |
| 2011/0215060 | A1 * | 9/2011 | Niederhuefner | 211/59.3 |
| 2011/0218889 | A1 * | 9/2011 | Westberg et al. | 705/28 |
| 2011/0282768 | A1 | 11/2011 | Swafford, Jr. et al. | |
| 2012/0006764 | A1 | 1/2012 | Hachmann et al. | |
| 2012/0091162 | A1 * | 4/2012 | Overhultz et al. | 221/1 |
| 2013/0247834 | A1 | 9/2013 | Kodat | |

FOREIGN PATENT DOCUMENTS

| | | | |
|---|---|---|---|
| EP | 1 256 296 | A2 | 11/2002 |
| EP | 1 541 064 | A1 | 6/2005 |
| EP | 1 541 064 | B1 | 2/2006 |
| GB | 2 304 102 | A | 3/1997 |
| GB | 2 360 514 | A | 9/2001 |
| NL | 1001794 | C2 | 6/1997 |
| WO | WO 91/03967 | | 4/1991 |
| WO | WO 2004/083051 | A2 | 9/2004 |
| WO | WO 2005/107535 | A1 | 11/2005 |

OTHER PUBLICATIONS

POS Tuning—für mehr Erfolg am Point of Sale: The POS T-Systemtray; http://www.postuning.de/68.0.html?L=2; website; Mar. 29, 2006; 1 page.

* cited by examiner

ALARMING PUSHER SYSTEM

FIELD OF THE INVENTION

This invention generally relates to pusher systems, in particular, to a pusher system employed with an alarm to prevent retail theft.

BACKGROUND OF THE INVENTION

Theft is a large problem in the retail industry. To combat theft of merchandise, the retail industry has utilized many products, such as alarming fixtures, Electronic Article Surveillance (EAS) tag systems, and locking mechanisms used to secure items.

Traditional alarming systems will activate an alarm to warn employees when a product has been removed from a display. As such, when a legitimate customer would like to purchase merchandise protected by these traditional alarm systems, it requires a store clerk to unlock the merchandise from the display protected by the alarming system. This type of retail theft deterrent is similar to a simple locking fixture, which merely secures the merchandise to the display. Both the alarming system and the locking fixture require a customer to first ask a store clerk to remove the merchandise from the display prior to purchasing the merchandise. Research in the retail industry has shown that merchandise that requires a store clerk to retrieve causes a gradual loss in sales.

An EAS tag system is used in conjunction with a gate, usually at the exit of the retail store. These systems typically require that each item of retail merchandise be fixed with a tag that will cause an alarm to activate if the merchandise is moved beyond the gate. Therefore, a store clerk will need to remove the tag subsequent to the customers purchasing the merchandise. The requirement for each retail merchandise item to be tagged means that many tags will need to be used, which will cut into the overhead cost of operating a retail store. Further, the store clerk will need to take the additional time to remove the tag that could be used to service other customers.

A pusher system is a popular device used to "face" merchandise, i.e. bias the merchandise to the leading edge of a retail shelf. A general description of a typical pusher system may be found at U.S. Pat. App. Pub. No. 2007/0267364 A1, the teachings and disclosure of which are hereinafter incorporated by reference.

A typical pusher system contains merchandise in an organized line or row. As a front most item is removed, a pusher of the pusher system biases the entire line or row forward such that the next item in the line or row, now the front most item is biased forward until it engages a stop of the pusher system that prevents further movement of the row.

Utilizing an alarming fixture, an EAS tag system, or a locking system on a pusher system retail display is inconvenient for the same reasons discussed above. Therefore, what is needed is a pusher system with an alarming system that does not require a store clerk to remove the merchandise from the display or remove a tag affixed to the merchandise prior to a customer purchasing said merchandise.

The invention provides such an alarming pusher system. These and other advantages of the invention, as well as additional inventive features, will be apparent from the description of the invention provided herein.

BRIEF SUMMARY OF THE INVENTION

In one aspect, an embodiment of the invention provides a retail merchandise pusher system that includes a retail merchandise guide track, a pusher plate, a front stop, and an alarm device. The merchandise guide track supports retail merchandise displayed on the pusher system. The pusher plate is operatively connected to a biasing mechanism configured to bias the pusher plate in a biasing direction along the merchandise guide track. The front stop is configured to prevent retail merchandise from being pushed off the pusher system by the pusher plate. The alarm device is operatively configured to activate an alarm when retail merchandise is removed from the pusher system.

In another aspect of the retail merchandise pusher system, the alarm device is mechanically fixed to the front stop by a first hook-shaped projection and a second hook-shaped projection. The first and second hook-shaped projections each have a contact portion and a distal portion. The contact portion extends perpendicularly from an inner facing surface of the front stop, and the distal portion curves back toward a center axis transverse to the biasing direction.

In yet another aspect of the retail merchandise pusher system, the alarm device is fixed to the front stop by foam adhesive strips. The foam adhesive strips are configured to adhere to a back surface of the alarm device to the front stop of the pusher system.

In another aspect, an embodiment of the invention provides an alarm device configured to monitor merchandise displayed on a retail pusher system. The alarm device includes a front surface, a back surface, and a switch. The front surface is oriented to face retail merchandise displayed on the retail pusher system. The back surface is operatively attached to a front stop of the retail pusher system, and the switch is located on the front surface of the alarm device. The switch is also oriented to interact with the retail merchandise displayed on the retail pusher system.

In another aspect, an embodiment of the invention provides a method of alerting retail store personnel of removal of retail merchandise from a retail pusher system. The method includes the steps of biasing retail merchandise to engage a triggering mechanism of an alarm device configured to monitor retail merchandise displayed on a retail pusher system. The method also includes activating a timed alarm when the triggering mechanism is not reengaged.

In yet another aspect, the method of alerting retail store personnel further includes waiting a predetermined period of time after expiration of the timed alarm, and activating a second timed alarm if the triggering mechanism is not reengaged within the predetermined period of time. After expiration of the second timed alarm, the method waits a predetermined second period of time, and activates a final alarm if the triggering mechanism is not reengaged.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
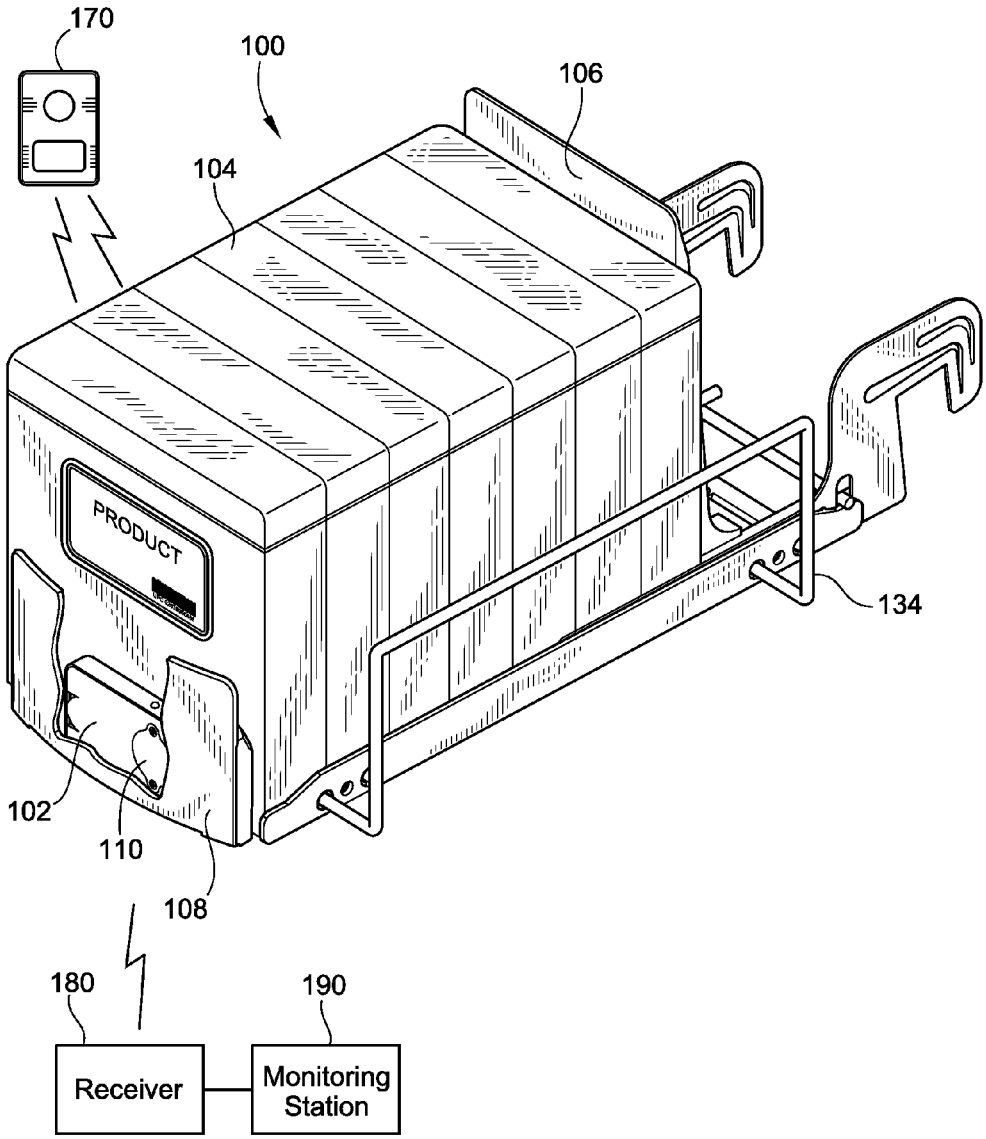
FIG. 1 is a perspective view of an exemplary embodiment of a pusher system including merchandise and an alarming device according to the teachings of the present invention.

FIG. 1 illustrates a pusher system 100 with an alarm device 102. The pusher system 100 includes sidewalls 134, 136 (see FIG. 2) and a pusher plate 106, which biases merchandise 104 toward the front stop 108. An alarm device 102 is securely attached to an inside face 138 (see FIG. 2) of front stop 108 such that merchandise 104 is biased into a triggering mechanism 112 (see FIG. 2) for the alarm device 102.

Figure 2:
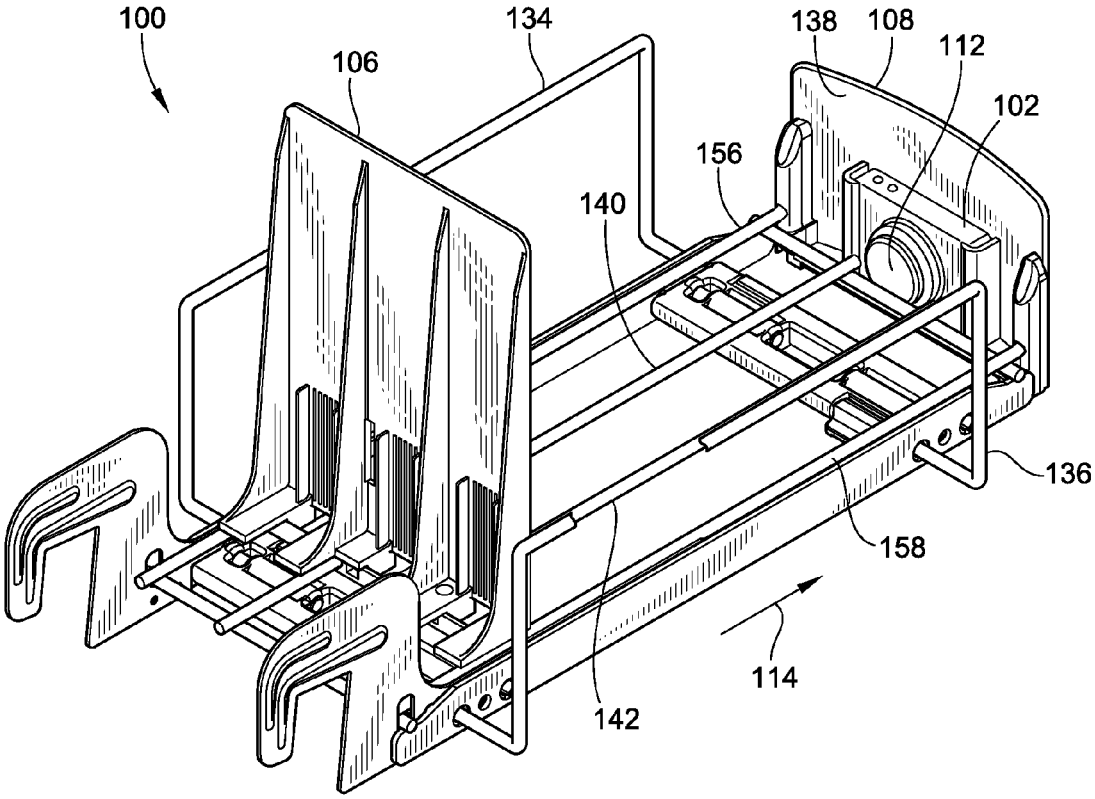
FIG. 2 is a perspective view of the pusher system of FIG. 1 that illustrates the front of the alarming device.

FIG. 2 illustrates a further perspective view of the pusher system 100 with an alarm device 102 shown in FIG. 1. In this view, the merchandise has been removed to show a merchandise guide track formed by inner guide rails 140, 142 and outer guide rails 156, 158. The pusher plate 106 slides along the guide rails 140, 142 in a biasing direction 114. The pusher plate 106 slides under force from a biasing mechanism such as an elastic band or a spring drive system. As such, the pusher plate 106 forces merchandise 104 (see FIG. 1) through a merchandise channel formed by the pusher plate 106, the sidewalls 134, 136, and the front stop 108.

FIG. 2 further illustrates the triggering mechanism 112 of the alarm device 102. In the embodiment of the invention shown in FIG. 2, the triggering mechanism 112 takes the form of a plunger switch 112. Typically, the plunger switch 112 will have a very light spring weight such that it is actuated under minimal pressure, approximately 1 ounce of weight should be capable of depressing a plunger of the plunger switch 112.

When the pusher system 100 is stocked with merchandise 104, as illustrated in FIG. 1, the pusher plate 106 biases the merchandise 104, in the biasing direction 114, into the plunger switch 112. In this configuration, the alarm device 102 is not activated. If a customer removes merchandise from the pusher system 100, then the plunger switch 112 will be released for a brief period as pusher system 100 moves additional product in the biasing direction 114. This causes the alarm device 102 to initiate an alarm that warns employees of the retail store that merchandise 104 has been removed from the pusher system 100. Once the pusher plate 106 pushes the remaining merchandise into the plunger switch 112, the alarm will stop.

As such, the alarm device 102 acts to inform employees of the retail merchandise store that merchandise 104 is active. For retail merchandise 104 to be active it is either being restocked or removed. Therefore, when one of those actions occurs, the alarm device 102 will inform both the customer that the merchandise 104 is being monitored and the store employees that merchandise 104 is active.

While in the embodiments illustrated in FIGS. 1-5 the triggering mechanism 112 is a plunger switch, one of ordinary skill in the art will appreciate that the triggering mechanism 112 could be implemented using a variety of other switches. For example, the triggering mechanism 112 could be in the form of a contact switch, or a light sensitive switch. Further, multiple types of light sensitive switches are contemplated, such as proximity detectors, infrared sensors, electro-optical sensors, or photodetectors.

In certain embodiments, the alarm is a timed alarm, which shuts off after the expiration of a specific amount of time as opposed to actuation of the triggering mechanism 112. However, in other embodiments, the alarm will only shut off when turned off either by a key or a remote control 170, as illustrated in FIG. 1.

In the configuration where the alarm is shut off using the remote control 170, the remote control 170 may be a short distance remote control 170 that operates only within a six foot radius around the remote control 170. Further, the alarm will only shut off for ten seconds prior to monitoring the merchandise once again. Therefore, if the triggering mechanism 112 is still not engaged, then the alarm will sound again.

In another embodiment, the alarm will sound for a longer period when the triggering mechanism 112 is actuated several times in a relatively short period of time. For instance, if the triggering mechanism is actuated four or more times within a ten second period of time the alarm may sound for thirty seconds or more. In other embodiments, if the triggering mechanism 112 is actuated several times within a short period of time, the alarm may sound indefinitely until a store employee manually shuts the alarm off.

Further, in certain embodiments, once the final item of merchandise 104 has been removed from the pusher system 100, the pusher plate may stop short of triggering the plunger switch 112 such that the alarm is constantly initiated so to indicate to employees of the retail store that all of the merchandise 104 has been removed from the pusher system 100. In this capacity, the alarm device 102 can be used to indicate to the retail store employees that merchandise 104 needs to be restocked.

In another embodiment, the alarm initiated by the alarm device 102 may be an audible alarm that both warns the employees of the retail store that merchandise has been removed and warns the customer that the product is being monitored. However, in other embodiments, the alarm may be silent by indicating to an employee tasked with monitoring merchandise that product has been removed from a specific pusher system 100.

Additionally, the alarm device 102 may be equipped to send a signal to a receiver 180 that communicates with a monitoring station 190 being watched by a store employee. In certain embodiments, the monitoring station 190 may receive e-mail notifications from the receiver 180 that is in communication with the alarm device 112. In other embodiments, the monitoring station 190 may be as small as a portable device equipped with software that allows the device to monitor each alarm device 102. As such, the portable device may be a cellular phone, tablet, or pager.

Furthermore, in another embodiment of the invention where the alarm may or may not be silent, the alarm device 102 communicates with the receiver 180 which in turn may transmit a message to a store pager system, which acts as the monitoring station 190. The message would trigger the store pager system to announce that help is needed in the section of the store where the alarm device 102 is located.

Additionally, FIGS. 1-2 illustrate only a single alarm device 102 being associated with a single pusher system 100. However, in certain embodiments, the alarm device may be associated with multiple plunger switches 112. In this configuration, the plunger switches 112 may each be associated with an individual pusher system 100 and located in a similar position as shown in FIG. 2, but instead of being associated with its own alarm device 102 the plunger switches 112 are connected along an electrical track such that if merchandise is removed from one individual pusher system 100 the alarm will activate, as described, to indicate that product has been removed from group of pusher systems 100 monitored by the alarm device 102. This allows multiple pusher systems 100 to be monitored by a single alarm device 102.

Figure 3:
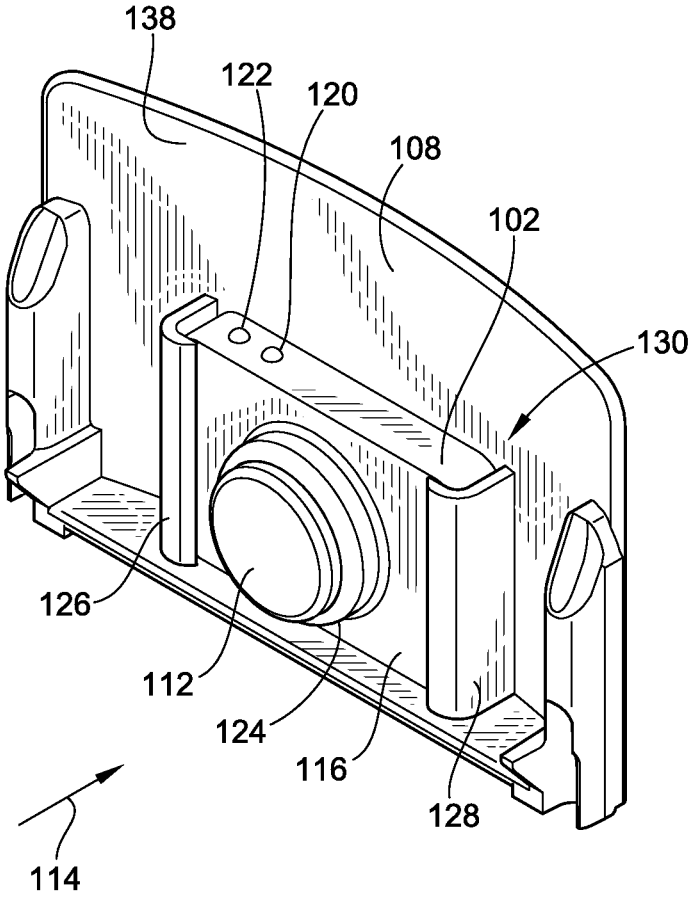
FIG. 3 is a an up-close view of the alarming device secured to a front face of the pusher system of FIG. 1.

FIG. 3 illustrates the alarm device 102 secured to the front stop 108 of the pusher system 100 (see FIG. 1). The front stop 108 includes a securing structure, which in the embodiment of the invention shown in FIG. 3 is in the form of two hook-shaped projections 126, 128. The hook-shaped projections 126, 128 extend perpendicular from an inner face 138 of the front stop 108 and curve back toward the inner face 138 at a distal end of the hook-shaped projections 126, 128. The hook-shaped projections' 126, 128 curved distal ends curve in opposite directions from each other and toward a center line 154 such that a securing pocket 130 is formed. The securing pocket 130 is formed by the two hook-shaped projections 126, 128 and a floor 152 of the front stop 108. The securing pocket 130 dimensions are such that when the alarm device 102 is inserted into the securing pocket 130, it is substantially fixed to the inner face 138 of the front stop 108.

Furthermore, the front stop 108 includes two fastening structures 144, 146. The two fastening structures 144, 146 define two passages 148, 150 that are hollowed such that upturned ends 160, 162 of outer guide rails 156, 158 are slideably disposed within the passages 148, 150. Therefore, the front stop 108 is secured to the pusher system 100 by the upturned ends 160, 162 inserted into the passages 148, 150.

Additionally, the alarm device 102 may be fixed to the front stop 108 by a variety of methods, such as the use of adhesive strips, in particular foam adhesive strips. The adhesive strips may be used as either in conjunction with the securing pocket 130 or on its own in an embodiment of the front plate 108 that does not include the securing pocket 130.

Figure 4:
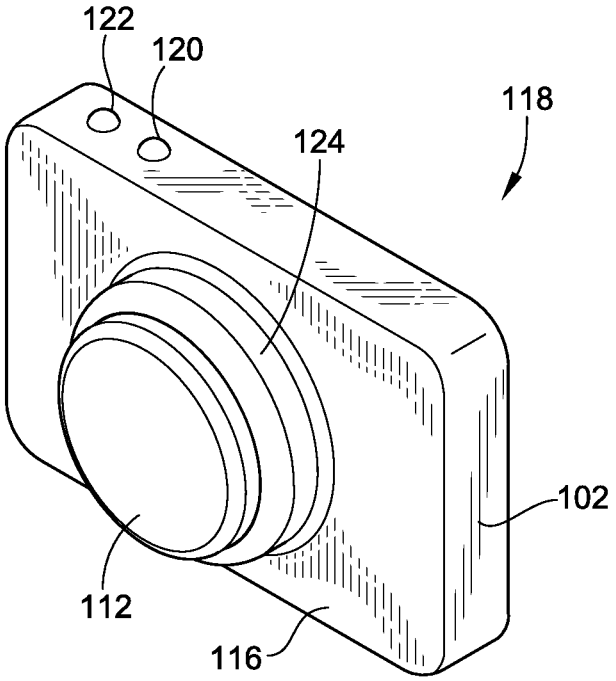
FIG. 4 is a front perspective view of an exemplary embodiment of an alarming device according to the teachings of the present invention.
Figure 5:
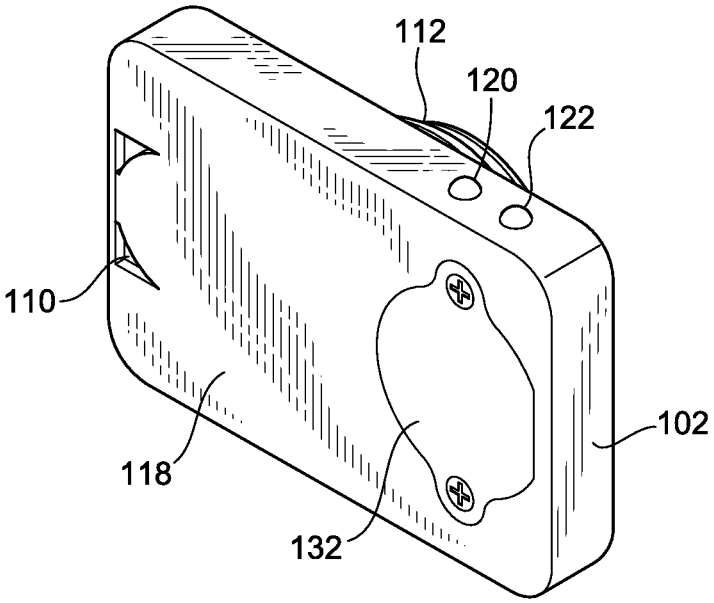
FIG. 5 is a rear perspective view of the alarming device of FIG. 4.

FIGS. 4 and 5 illustrate a front and back, respectively, of the alarm device 102. As shown in FIG. 4, the alarm device 102 includes a front surface 116 from which an annular wall 124 extends. The annular wall 124 defines a space that holds the plunger switch 112, which activates and deactivates the alarm of the alarm device 102.

Furthermore, the alarm device 102 includes two indicator lights 120, 122. Indicator lights 120, 122 provide a visual indication of whether the alarm device is turned on and when the alarm of the alarm device is activated. While the indicator lights illustrated in FIGS. 1-5 are located on the alarm device 102, it is contemplated that the indicator lights could also be fixed to a front face 164 of the front stop 108. In this configuration, the indicator lights will be easier to view from a position further away from the actual pusher system.

FIG. 5 illustrates the back surface 118 of the alarm device 102. The back surface 118 of the alarm device 102 includes a battery cover 132, which is removable to provide access to a battery port (not illustrated) where a battery or batteries would be disposed in order to provide power to the alarm device 102. However, it is contemplated that other embodiments of the alarm device 102 may not be powered by battery, but rather be powered directly from an external power source.

FIG. 5 also illustrates a resonant cavity 110. Resonant cavity 110 allows an audible alarm generated by an internal speaker or noise generation device (not illustrated) to be heard outside of the alarm device 102. The resonant cavity 110 as illustrated in FIG. 4 includes two triangular openings in the back surface 118 of the alarm device 102. One of ordinary skill in the art will understand that triangular openings are one of several geometries that will allow a sufficient opening such that the audible alarm emanating from the resonant cavity 110 will be loud enough to serve the purpose of warning employees that merchandise 104 (see FIG. 1) has been removed from the pusher system 100 (see FIG. 1).

Figure 6:
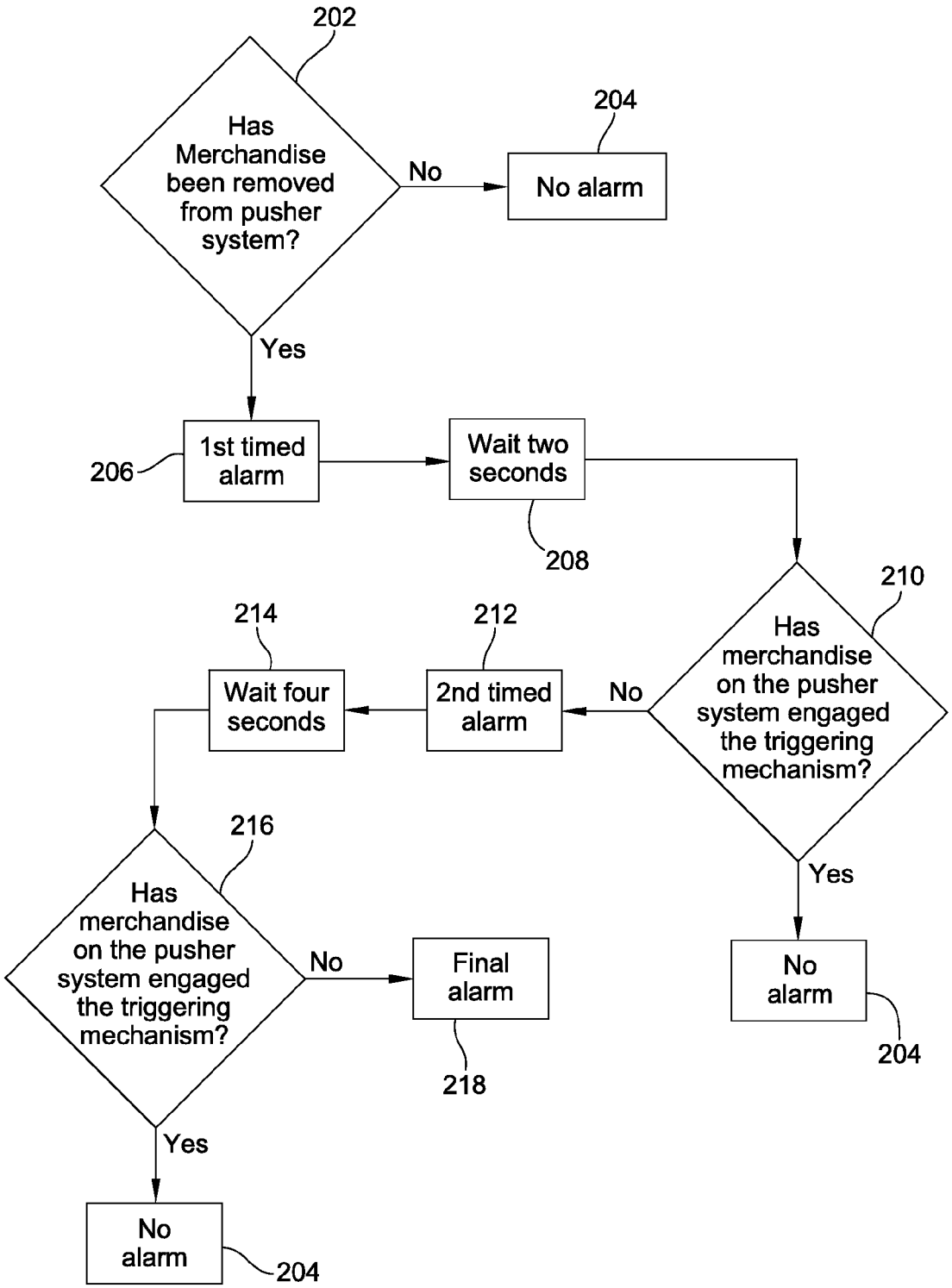
FIG. 6 is a flow chart illustrating a method of instituting an alarm in accordance with an exemplary embodiment of the present invention.

FIG. 6 illustrates a flow chart 200 detailing a specific method of instituting a timed alarm in the alarm device 102 (see FIGS. 1-5). The flow chart 200 begins with a decision block 202, which asks whether merchandise has been removed from a pusher system monitored by an alarm device 102. As described above, the alarm device 102 includes a triggering mechanism 112 that indicates when merchandise has been removed from the pusher system. If this triggering mechanism 112 has not been actuated then the alarm device 102 does not issue an alarm. This state is represented by the "no alarm" box 204.

However, if the triggering mechanism 112 indicates that merchandise has been removed, then the alarm device 102 provides a first timed alarm 206. Generally, the first timed alarm 206 is a light chime or sound to merely indicate to the store employees that merchandise has been removed and to the customer that the merchandise is being monitored. After the first timed alarm 206 expires, the flow chart 200 includes a delay block 208, which indicates a two second delay. After the expiration of the two second delay, the flow chart 200 asks whether merchandise has once again engaged the triggering mechanism 112. If the answer to this question is yes, then the flow chart 200 proceeds back to the no alarm box 204.

However, if once again, merchandise is not engaging the triggering mechanism 112, then a second timed alarm 212 is issued from the alarm device 102. After the expiration of the second timed alarm 212, the flow chart 200 includes a second delay block 214, which indicates a four second delay. After expiration of the four second delay, the flow chart 200 includes a decision block 216 that asks once again whether merchandise has engaged the triggering mechanism 112. If the answer to this question is yes, then the flow chart 200 proceeds back to the no alarm box 204. If merchandise has not engaged the triggering mechanism 112 after the expiration of the four second delay, then a final alarm 218 is issued from the alarm device 102. The final alarm 218 is a much longer timed alarm that generally last for 30 seconds.

The second and final timed alarm 212, 218 are generally present to indicate to retail store employees that a pusher system 100 (see FIGS. 1-2) no longer has merchandise displayed. However, the second and final alarms 212, 218 also will indicate a malfunctioning pusher system 100 in that if the pusher plate 106 is stuck or the biasing mechanism fails, then the merchandise will not be biased in the biasing direction 114 to engage the triggering mechanism 112.

The above description of the operation of the method of instituting a timed alarm detailed in flow chart 200 includes specific times for delays of two second for the first delay 208 and four seconds for the second delay 216. One of ordinary skill in the art would realize that these times can be increased or decreased based on the specific retail environment. Further, one of ordinary skill in the art would also realize that the length of the first, second, or third timed alarm could also be lengthened or shortened based on the specific retail environment in which the alarm device 102 is employed.

Furthermore, the embodiment of the invention illustrated in FIG. 6 can be adapted to operate where the alarm device 102 triggers a store pager system. In this configuration, the final alarm 218 may or may not be silent, and at the final alarm block 218, the alarm device 102 will transmit a message to the store pager system that will cause an announcement that help is needed in the specific section of the store where the alarm device 102 is located. Also, while in this embodiment, the message is transmitted at the final alarm stage 218, in other embodiments, the message may be transmitted earlier during the first or second alarm stages 206, 212.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail merchandise pusher system, comprising: a merchandise guide track for supporting retail merchandise displayed on the pusher system; a pusher plate operatively connected to a biasing mechanism configured to bias the pusher plate in a biasing direction along the merchandise guide track; a front stop having a front surface facing away from the retail merchandise and a back surface facing towards the retail merchandise, the front stop configured to prevent retail merchandise from being pushed off the pusher system by the pusher plate; and an alarm device mechanically fixed against the back surface of the front stop and operatively configured to activate an alarm when retail merchandise is removed from the pusher system, the alarm device including an outer housing and an internal audible tone generation device carried within the housing, wherein the alarm device is mechanically fixed to the front stop by a first hook-shaped projection and a second hook-shaped projection, the first and second hook-shaped projections each have a contact portion and a distal portion, the contact portion extends perpendicularly from an inner facing surface of the front stop and the distal portion curves back toward a center axis transverse to the biasing direction, wherein the triggering device is a plunger switch located on a front surface of the alarm device, and further comprising a remote control that allows a user to deactivate the alarm.

2. The retail merchandise pusher system of claim 1, wherein the alarm device is fixed to the front stop by foam adhesive strips configured to adhere a back surface of the alarm device to the front stop.

3. The retail merchandise pusher system of claim 1, wherein the alarm device includes a triggering mechanism that activates an alarm when retail merchandise is removed from the pusher system.

4. The retail merchandise pusher system of claim 1, wherein the plunger switch faces the pusher plate such that the pusher plate biases retail merchandise into the plunger switch.

5. The retail merchandise pusher system of claim 4, wherein the plunger switch is actuated under one ounce of pressure.

6. The retail merchandise pusher system of claim 3, wherein the triggering mechanism is a contact switch.

7. The retail merchandise pusher system of claim 3, wherein the triggering mechanism is a light sensitive switch.

8. An alarm device configured to monitor retail merchandise displayed on a retail pusher system, comprising: an outer housing having a front surface oriented to face retail merchandise displayed on a retail pusher system; the outer housing further comprising a back surface configured for attachment to a front stop of the retail pusher system; and a switch located on the front surface and oriented to interact with the retail merchandise displayed on the retail pusher system such that a lead item of the retail merchandise will contact the switch upon being biased forward by the retail pusher system, wherein the switch is electrically coupled to an internal audible tone generation device carried within the housing, wherein the alarm device is mechanically fixed to the front stop by a first hook-shaped projection and a second hook-shaped projection, the first and second hook-shaped projections each have a contact portion and a distal portion, the contact portion extends perpendicularly from an inner facing surface of the front stop and the distal portion curves back toward a center axis transverse to the biasing direction, wherein the triggering device is a plunger switch located on a front surface of the alarm device, and further comprising a remote control that allows a user to deactivate the alarm.

9. The alarm device of claim 8, wherein the back surface includes at least one foam adhesive strip configured to adhere the alarm device to the front stop of the retail pusher system.

10. The alarm device of claim 8, wherein the switch is a plunger switch that activates an alarm when the plunger switch is not engaged.

11. The alarm device of claim 8, wherein the back surface includes a resonant structure configured to allow an alarm to sound from the alarm device.

12. The alarm device of claim 8, wherein the switch is a contact switch.

13. The alarm device of claim 9, wherein the switch is a light sensitive switch.

* * * * *